US006958645B2

(12) United States Patent
Okabayashi

(10) Patent No.: US 6,958,645 B2
(45) Date of Patent: Oct. 25, 2005

(54) BELT TYPE FIXING DEVICE

(75) Inventor: Eiji Okabayashi, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/400,788

(22) Filed: Mar. 28, 2003

(65) Prior Publication Data

US 2003/0185605 A1 Oct. 2, 2003

(30) Foreign Application Priority Data

Mar. 28, 2002 (JP) ..... 2002-091027

(51) Int. Cl.[7] ..... G03G 15/20
(52) U.S. Cl. ..... 329/329; 219/216
(58) Field of Search ..... 399/328, 329, 399/334, 335; 219/216

(56) References Cited

U.S. PATENT DOCUMENTS 5,053,829 A * 10/1991 Field et al. ..... 399/329
5,115,279 A * 5/1992 Nishikawa et al. ..... 399/331
5,752,148 A 5/1998 Yoneda et al.
5,873,020 A * 2/1999 Matsuura et al. ..... 399/329
5,973,020 A * 10/1999 Kerr et al. ..... 522/25
6,185,383 B1 * 2/2001 Kanari et al. ..... 399/45
6,631,253 B2 * 10/2003 Nakafuji et al. ..... 399/329

FOREIGN PATENT DOCUMENTS

| | | | | |
|---|---|---|---|---|
| JP | 05-107961 | | 4/1993 | |
| JP | 08-137306 | | 5/1996 | |
| JP | 09114283 A | * | 5/1997 | ..... G03G 15/20 |
| JP | 09-218610 | | 8/1997 | |
| JP | 2000105515 A | * | 4/2000 | ..... G03G 15/20 |
| JP | 2000137397 A | * | 5/2000 | ..... G03G 15/20 |
| JP | 2001228731 A | * | 8/2001 | ..... G03G 15/20 |

* cited by examiner

*Primary Examiner*—Robert Beatty
(74) *Attorney, Agent, or Firm*—Buchanan Ingersoll PC

(57) ABSTRACT

A belt type fixing device of the invention comprises a fixing belt, a heating panel, a pressure member, and a pressure roller. The heating panel has a curved outer surface in sliding contact with the inner surface of the fixing belt and a curved inner surface on which a resistance heating band element is formed. The resistance heating band element is formed in a zigzag pattern with a plurality of stripes perpendicular to the direction in which the fixing belt moves. The pressure member gives tension to the fixing belt in cooperation with the heating panel and has an elastic body in sliding contact with the inner surface of the fixing belt. The pressure roller rotating in a predetermined direction applies pressure to toner carrying recording paper led into a nip formed by the pressure roller and the pressure member.

13 Claims, 3 Drawing Sheets

BELT TYPE FIXING DEVICE

This application is based on application No. 2002-091027 filed in Japan, the content of which is hereby incorporated by reference.

BACKGROUND OF THE INVENTION

1. Field of the Invention

The present invention relates to a belt type fixing device which is used to fix toner in an electrophotographic imaging apparatus such as a photocopier, printer, or facsimile.

2. Description of the Related Art

A conventional fixing device in an imaging apparatus typically used a pair of rollers to heat and press a recording sheet carrying toner. However, as color imaging apparatuses have spread, a belt type fixing device which heats the nip adequately and may be compact has been proposed.

In the belt type fixing device, usually a belt wound and put between two rollers is heated at a point away from the nip and the heat given to the belt is transferred to unfixed toner through circular movement of the belt. In this structure, a heat source need not be located at the nip, more specifically inside a fixing roller, as in the conventional fixing device, so a low-hardness elastic layer with a low thermal conductivity may be provided at the nip. The use of such a low-hardness elastic layer assures a wider nip.

One example of this type of belt type fixing device is disclosed in Japanese Patent Laid-open No. H08-137306. In this prior art, a fixing belt is put between two rotary rollers and an electromagnetic induction coil is located on the belt between the rollers to heat the belt directly. Since these rollers need circularly rotate the belt with a tensile force, they must have a relatively high strength and thus the rollers should have a relatively large thermal capacity. Hence, some of the heat of the belt spreads to the rollers. Since the rollers absorb some of the heat of the belt because of the large thermal capacity in this way, it is difficult to shorten the warming up time further even though the heating efficiency is improved by electromagnetic induction.

Another example is the method disclosed in Japanese Patent Laid-open No. H05-107961 whereby a heating body is in sliding contact with the outer surface of a heating roller in order to shorten the warming up time. Since the sliding contact surface is a fixing plane and vulnerable to scratching, there is the problem of low durability.

Also, there have been attempts to provide anon-rotary heater at the nip for direct heating. In this case, however, the heater must have both a heating function and a pressing function, so it is difficult to provide a wider nip and the heater holder and the heater must be manufactured with a high dimensional precision and accurately assembled, which increases the manufacturing cost.

SUMMARY OF THE INVENTION

The present invention has been made in view of the above problems of the prior art and provides an energy-efficient belt type fixing device which reduces cost and shortens warming up time.

The above problems are solved by the present invention as follows. According to a first aspect of the present invention, there is provided a fixing belt; a heating panel having a curved outer surface in sliding contact with the inner surface of the fixing belt and a curved inner surface on which a resistance heating band element is formed; a pressure member, which gives tension to the fixing belt in cooperation with the heating panel, having an elastic body in sliding contact with the inner surface of the fixing belt; and a pressure roller rotated in a predetermined direction for applying pressure to toner carrying recording paper led into a nip formed by the pressure roller and the pressure member, here, the resistance heating band element is formed in a zigzag pattern with a plurality of stripes perpendicular to the direction in which the fixing belt moves.

According to a second aspect of the invention, in the belt type fixing device according to the first aspect, a first heating zone corresponding to narrower recording paper; a second heating zone corresponding to wider recording paper; a first pair of terminals for supplying electric power to the first heating zone; and a second pair of terminals for supplying electric power to both the first heating zone and the second heating zone at the same time.

According to a third aspect of the present invention, in the belt type fixing device according to the second aspect, one of the first pair of terminals is common to one of the second pair of terminals.

According to a fourth aspect of the present invention, in the belt type fixing device according to the third aspect, the resistance heating band element is electrically insulated from the body of the heating panel.

According to a fifth aspect of the present invention, there is provided a belt type fixing device comprising: a fixing belt; a heating panel having a curved outer surface in sliding contact with the inner surface of the fixing belt and a curved inner surface on which a resistance heating band element is formed; a pressure member, which gives tension to the fixing belt in cooperation with the heating panel, having an elastic body in sliding contact with the inner surface of the fixing belt; and a pressure roller rotated in a predetermined direction for applying pressure to toner carrying recording paper led into a nip formed by the pressure roller and the pressure member, here, the resistance heating band element has a first heating zone and a second heating zone respectively formed in zigzag patterns with pluralities of stripes perpendicular to the direction in which the fixing belt moves; and the first and second heating zones have heating widths corresponding to narrower and wider recording paper respectively and are bonded to each other with an electrical insulator between them.

According to a sixth aspect of the present invention, in the belt type fixing device according to the fifth aspect, the resistance heating band element is electrically insulated from the heating panel.

According to a seventh aspect of the present invention, there is provided a belt type fixing device comprising: a fixing belt; a heating panel having a curved outer surface in sliding contact with the inner surface of the fixing belt and a curved inner surface on which a resistance heating band element is formed; a pressure member, which gives tension to the fixing belt in cooperation with the heating panel, having an elastic body in sliding contact with the inner surface of the fixing belt; and a pressure roller rotated in a predetermined direction for applying pressure to toner carrying recording paper led into a nip formed by the pressure roller and the pressure member, here, the resistance heating band element has a first heating zone and a second heating zone perpendicular to the direction in which the fixing belt moves; the first heating zone has a heating width corresponding to narrower recording paper and electric power is supplied thereto through a first pair of terminals; and the second heating zone has a heating width corresponding to wider recording paper and electric power is supplied thereto through both the first pair of terminals and a second pair of terminals at the same time.

According to an eighth aspect of the present invention, in the belt type fixing device according to the seventh aspect, the resistance heating band element is electrically insulated from the heating panel.

Thus, a belt type fixing device according to the present invention provides a high efficiency in temperature rise due to the very small thermal capacity of the heating panel. In addition, it is highly energy saving because it has to be turned on only when necessary and the heating zone can be selected depending on the width of recording paper. Besides, since there is not so much structural restriction as when a halogen heater is used, the size and weight of the fixing device can be reduced. Furthermore, since heat is conveyed to the fixing belt through contact with the cylinder surface, heat transfer takes place efficiently and responsively, assuring a high energy efficiency. Also, since an elastic material with a small thermal capacity and a low thermal conductivity such as sponge can be used as the elastic body for the pressure member, heat loss caused by heat transfer to the elastic body is reduced and the heat from the fixing belt is transferred to the toner (image) efficiently.

BRIEF DESCRIPTION OF THE DRAWINGS

The invention will be more particularly described with reference to the accompanying drawings, in which.

DETAILED DESCRIPTION OF THE PREFERRED EMBODIMENTS

First Embodiment

Figure 1:
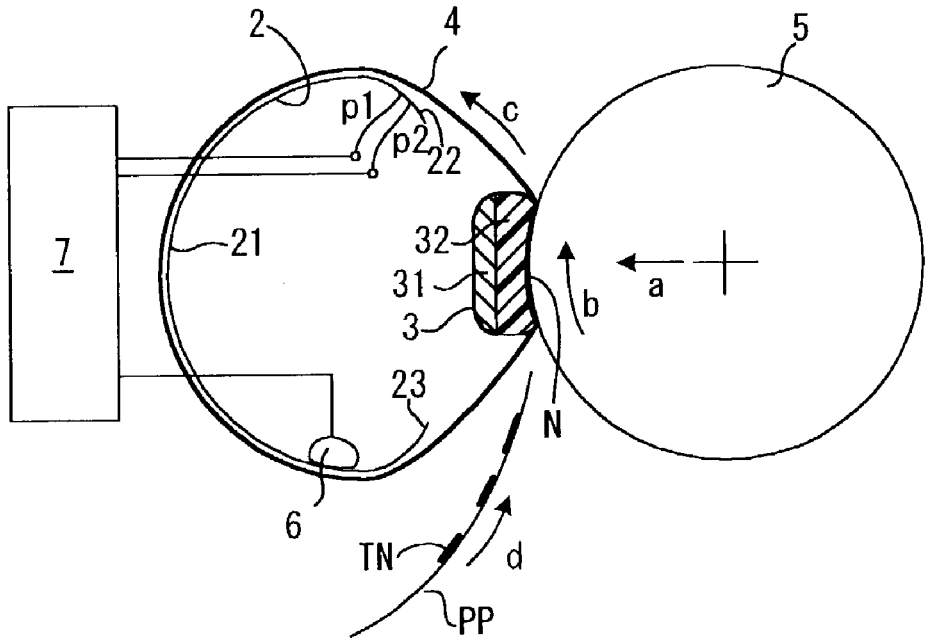
FIG. 1 is a sectional view showing the belt type fixing device structure which is common among various embodiments of the present invention.

Next, preferred embodiments of the present invention will be described referring to the accompanying drawings. FIG. 1 is a sectional view showing the belt type fixing device structure which is common among various embodiments of the present invention. This belt type fixing device 1 has a heating panel 2, a pressure member 3, a fixing belt 4, a pressure roller 5, a temperature sensor 6, and a controller 7.

The fixing belt 4 lies over both the pressure member 3 and the pressure panel 2 with an adequate level of tension. In this first embodiment, the pressure member 3 is indicated as a pressure pad which consists of a heat-resistant elastic body 32 (such as sponge) fixed on a rigid base 31. The pressure roller 5 provides a momentum force as indicated by arrow a, which presses the fixing belt 4 against the pressure member 3. This momentum force deforms the elastic body 32 and the fixing belt 4 according to the circular sectional profile of the pressure roller 5, forming a nip N between the rollers.

The heating panel 2 consists of a surface 21 of a cylinder with a nearly circular cross section, an inlet guide 22 which is curving inwards and continuous with the cylinder surface 21, and an outlet guide 23. The inlet guide 22 and outlet guide 23 respectively lead the fixing belt 4 to help it get into contact and get out of contact smoothly, while preventing the belt from being scratched by an edge. The cylinder surface 21 is in contact with the fixing belt 4 over a large area, transferring most of the heat from the heating panel 2 by contact.

As the pressure roller 5 rotates in the direction of arrow b, the fixing belt is driven to rotate in the direction of arrow c circularly. Recording paper PP which carries unfixed toner TN forming an image is led from the direction of arrow d into the nip between the pressure roller 5 and the fixing belt 4 and heated and pressed there. The heat and pressure dissolves the toner and fixes it on the recording paper PP. This heat has been transferred from the cylinder surface 21 of the heating panel 2 to the fixing belt 4; in other words, it has been conveyed to the nip N through the above-mentioned circular rotation of the fixing belt 4.

On the reverse side of the cylinder surface 21 of the heating panel 2, there is a planar resistance heating element area 24 which generates heat through an external power source for heating. A desirable material for the cylinder surface 21 is an aluminum plate because it is excellent in thermal conductivity and inexpensive.

Figure 2:
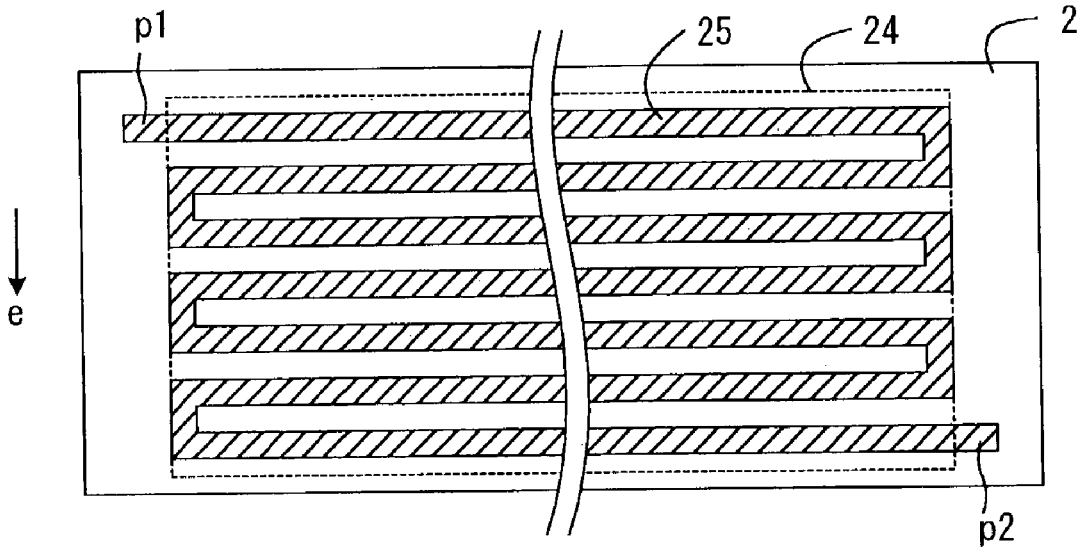
FIG. 2 is a development showing a resistance heating element area 24 according to a first embodiment of the present invention.

FIG. 2 is a development showing a resistance heating element area 24 according to the first embodiment of the present invention. As shown in FIG. 2, a resistance heating element 25 consists of a thin metal plate, insulated from the cylinder surface 21, which is so shaped as to form a pattern with several or dozens of stripes perpendicular to the moving direction of the fixing belt 4 as indicated by arrow e. It generates heat when voltage is applied to terminals p1 and p2 at both ends.

The heating element stripes perpendicular to the direction indicated by arrow e are intended to assure a uniform heat distribution across the fixing belt. The resistance heating element 25 is manufactured as follows: a thin metal plate (SUS or the like) and a polyimide resin plate are bonded together, then the above-mentioned stripe pattern (masking) and terminals are printed on the thin metal plate before the metal plate is etched to remove the metal other than its pattern area. Instead of the bonding process, the metal plate may be coated with polyimide resin. It is also possible to make a resistance heating element pattern by coating a polyimide resin plate with conductive paint, though this process is not recommended because it is costly and the problem of uneven heat generation might often arise due to the difficulty of making a thin coating with a uniform thickness. The recommended thickness range for the above thin metal plate is 20 $\mu$m or more, preferably around 30 $\mu$m.

Since the heating panel 2 is a thin plate, its thermal capacity may be very small. This means that its temperature quickly rises after the power is once turned off and back on. Therefore, it considerably saves energy because it has to be turned on only when necessary. In addition, unlike a halogen heater which generates heat by radiation and thus requires a structure for surrounding the heater, it does not require such a structure, so a compact and lightweight fixing device can be realized. Furthermore, since heat is conveyed to the fixing belt 4 through contact with the cylinder surface 21, heat transfer takes place efficiently and responsively. This also brings about a considerable effect of energy saving.

The elastic body 32 of the pressure member 3, such as sponge, is small in both thermal capacity and thermal conductivity and thus loss of the heat conveyed to the nip N, which is caused by its spread to the elastic body 32, is small. Consequently, the heat from the fixing belt 4 is transferred to the toner TN (image) efficiently.

The temperature sensor 6 is a sensor such as a thermistor, which is fitted to the heating panel 2 in order to measure the temperature of the panel. Preferably it should be located at the downstream along the direction in which the fixing belt 4 moves. Since the temperature of the heating panel 2 eventually corresponds to that of the fixing belt 4, the temperature sensor 6 also serves as a temperature sensor for the fixing belt 4. The temperature sensor 6 is connected with the controller 7 which controls the AC power to the heating panel 2 according to the detected temperature. A thyristor is typically used to control this power but any power control method may be used.

Second Embodiment

In the explanations of the second to fourth embodiments which will be given below, the same reference numerals as in the first embodiment represent the same components and descriptions of the same structure and effect of a belt type fixing device as in the first embodiment will be omitted to avoid redundancy.

Figure 3:
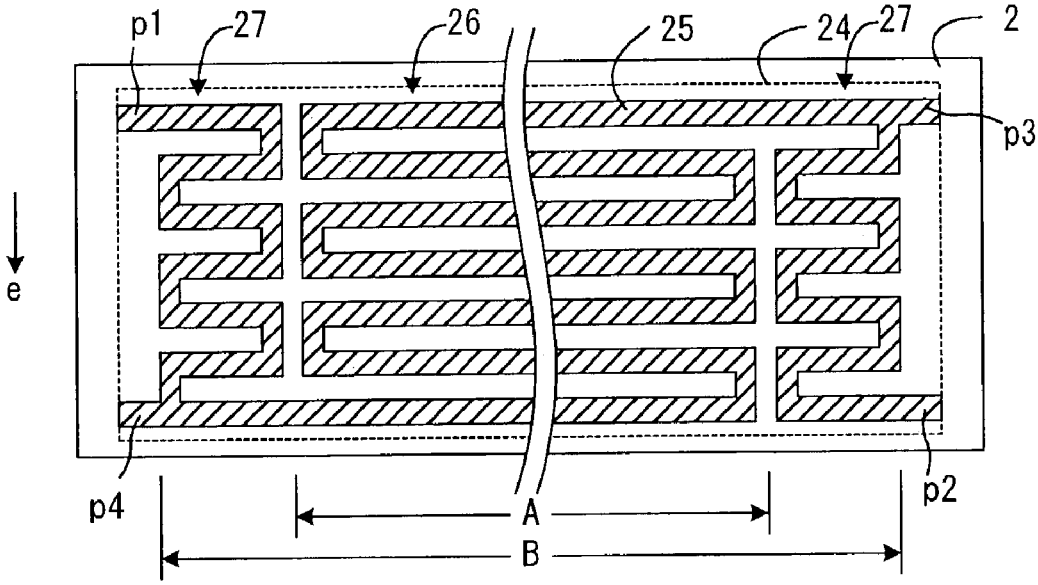
FIG. 3 is a development showing a resistance heating element area 24 according to a second embodiment of the present invention.

FIG. 3 is a development showing a resistance heating element area 24 according to the second embodiment. As shown in FIG. 3, a resistance heating element 25 consists of a thin metal plate, insulated from the cylinder surface 21, which is so shaped as to form a pattern with several or dozens of stripes perpendicular to the moving direction of the fixing belt 4 as indicated by arrow e, with a first heating zone 26 for a smaller recording paper width (width A) and second heating zones 27 for a larger recording paper width (width B). The second embodiment is suitable for use in an imaging apparatus in which recording paper is transported with reference to the paper center across the width of the paper being transported. There are two second heating zones 27, one on each side of the first heating zone 26.

A first pair of terminals (terminals p3 and p4) are provided in order to supply power to the first heating zone 26; and a second pair of terminals (terminals p1 and p2) are provided in order to supply power to both the first heating zone 26 and the second heating zones 27. As voltage is impressed between the terminals p1 and p2 (or between p3 and p4), heat is generated in the area corresponding to width B (or width A).

Third Embodiment

Figure 4:
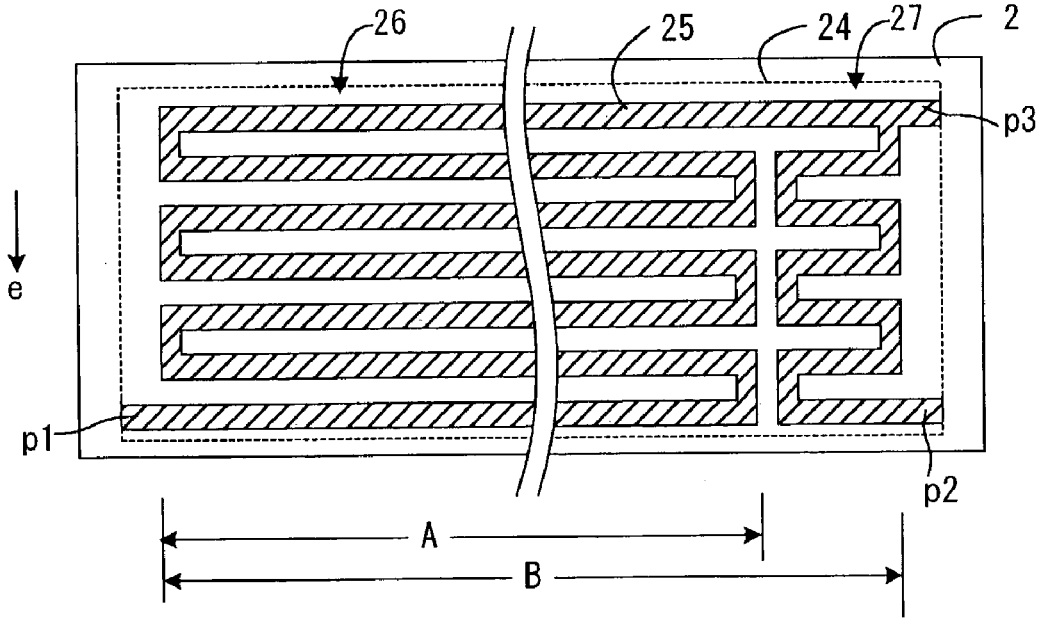
FIG. 4 is a development showing a resistance heating element area 24 according to a third embodiment of the present invention.

FIG. 4 is a development showing a resistance heating element area 24 according to a third embodiment of the present invention. Unlike the second embodiment, in which there are two second heating zones 27, or one on each side of the first heating zone 26, there is a second heating zone 27 on only one side of the first heating zone 26 in the third embodiment. The third embodiment is suitable for use in an imaging apparatus in which recording paper is transported with reference to the paper end across the paper width.

A first pair of terminals (terminals p1 and p3) are provided in order to supply power to the first heating zone 26; and a second pair of terminals (terminals p1 and p2) are provided in order to supply power to both the first heating zone 26 and the second heating zone 27 (terminal p1 is common for both the zones). As voltage is impressed between terminals p1 and p2 (or between p1 and p3), heat is generated in the area corresponding to width B (or width A).

Fourth Embodiment

Figure 5:
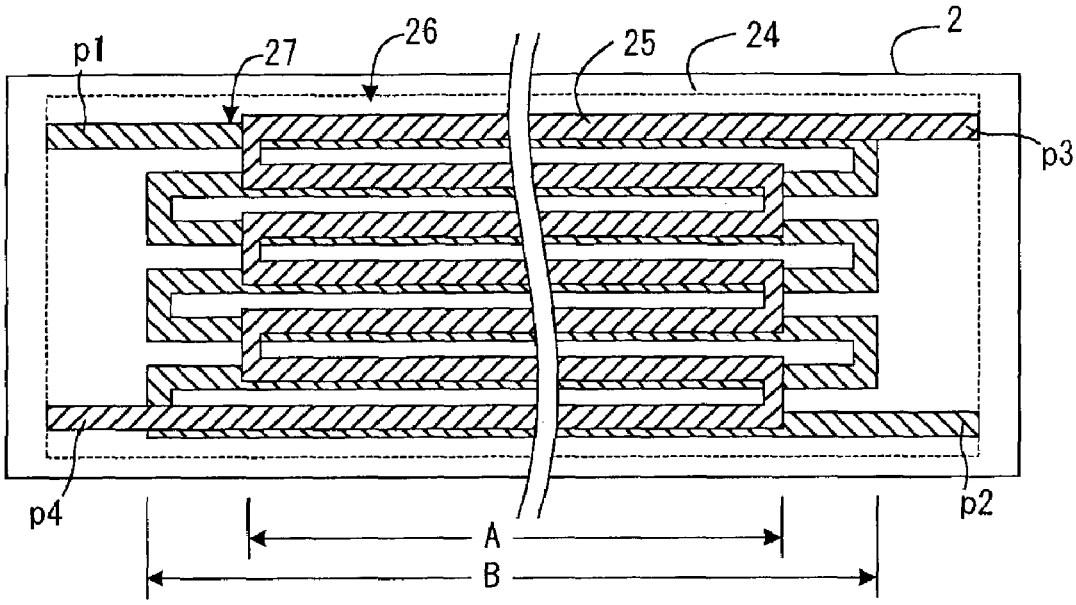
FIG. 5 is a development showing a resistance heating element area 24 according to a fourth embodiment of the present invention.

FIG. 5 is a development showing a resistance heating element area 24 according to a fourth embodiment of the present invention. While the first heating zone 26 and the second heating zone(s) 27 are on the same plane in the second and third embodiments, the first heating zone 26 lies over (or under) the second heating zone 27 with an insulator between them in the fourth embodiment. In the fourth embodiment, recording paper may be transported with reference to the paper center or paper end across the paper width and the paper positioning reference line can be switched simply by shifting the first heating zone 26 or the second heating zone 27 to the right or left.

A first pair of terminals (terminals p3 and p4) is provided in order to supply power to the first heating zone 26; and a second pair of terminals (terminals p1 and p2) is provided in order to supply power to the second heating zone 27. As voltage is impressed between terminals p1 and p2 (or between p3 and p4), heat is generated in the area corresponding to width B (or width A).

Fifth Embodiment

Figure 6:
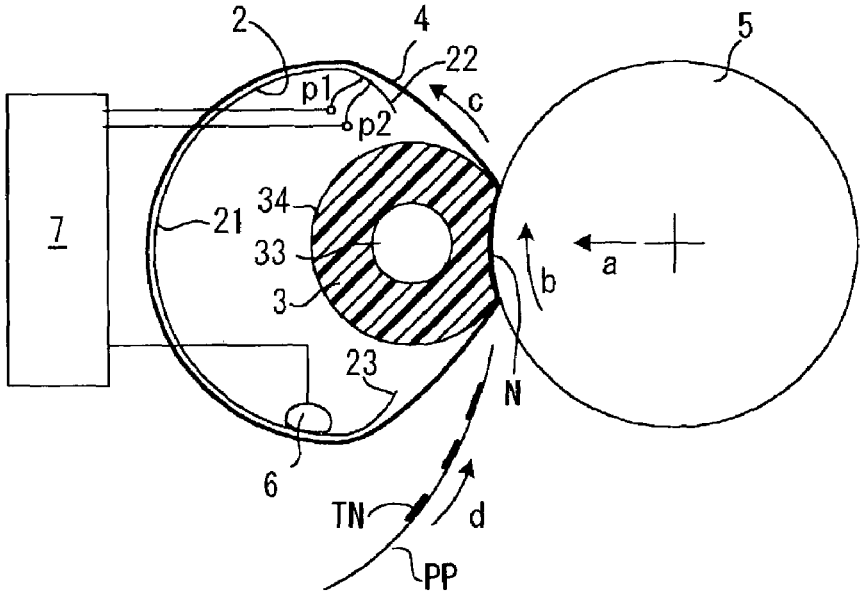
FIG. 6 is a sectional view showing a belt type fixing device using a different type of pressure member 3 according to a fifth embodiment of the present invention.

FIG. 6 shows a structure which uses, as the pressure member 3, a roller composed of a heat-resistant elastic body 34, such as sponge, wound around a rigid core 33. In this case, preferably there should be virtually no slip between the fixing belt 4 and the pressure member 3 and they should rotate together. In this structure, components other than the pressure member 3 are the same as in the above embodiments. For information on the other components, refer to their descriptions given above.

In the embodiments explained so far, since the heating panel 2 is a thin plate, its thermal capacity may be very small, and thus its temperature quickly rises after the power is once turned off and back on. Therefore, it considerably saves energy because it has to be turned on only when necessary and, in the above embodiments except the first embodiment, the heating zone can be selected depending on the width of recording paper. In addition, unlike a halogen heater which generates heat by radiation and thus requires a structure for surrounding the heater, it does not require such a structure, so a compact and lightweight fixing device can be realized. Furthermore, since heat is conveyed to the fixing belt 4 through contact with the cylinder surface 21, heat transfer takes place efficiently and responsively. This also largely contributes to energy saving.

The elastic body 32 of the pressure member 3, such as sponge, is small in both thermal capacity and thermal conductivity and thus loss of the heat transferred to the nip N, which is caused by its spread to the elastic body 32, is small. Consequently, the heat from the fixing belt 3 is transferred to the toner TN (image) efficiently.

What is claimed is:

1. A belt type fixing device comprising:

a fixing belt;

a heating panel having a curved outer surface in sliding contact with the inner surface of said fixing belt and a curved inner surface on which a resistance heating band element is formed;

a pressure member, which gives tension to said fixing belt in cooperation with said heating panel, having an elastic body in sliding contact with said inner surface of said fixing belt; and a pressure roller rotated in a predetermined direction for applying pressure to toner carrying recording paper led between said pressure roller and said pressure member, said pressure member extending and applying pressure to an entire length of said fixing belt which is in contact with said pressure roller in a paper transport direction, wherein said resistance heating band element is formed in a zigzag pattern with a plurality of stripes perpendicular to the direction in which said fixing belt moves.

2. A belt type fixing device according to claim 1, wherein said resistance heating band element has:

a first heating zone corresponding to narrower recording paper;

a second heating zone corresponding to wider recording paper;

a first pair of terminals for supplying electric power to said first heating zone; and a second pair of terminals for supplying electric power to both said first heating zone and said second heating zone at the same time.

3. A belt type fixing device according to claim 2, wherein one of said first pair of terminals is common to one of said second pair of terminals.

4. A belt type fixing device according to claim 3, wherein said resistance heating band element is electrically insulated from the body of said heating panel.

5. A belt type fixing device comprising:

a fixing belt;

a heating panel having a curved outer surface in sliding contact with the inner surface of said fixing belt and a curved inner surface on which a resistance heating band element is formed;

a pressure member, which gives tension to said fixing belt in cooperation with said heating panel, having an elastic body in sliding contact with said inner surface of said fixing belt; and a pressure roller rotated in a predetermined direction for applying pressure to toner carrying recording paper led between said pressure roller and said pressure member, said pressure member extending and applying pressure to an entire length of said fixing belt which is in contact with said pressure roller in a paper transport direction, wherein said resistance heating band element has a first heating zone and a second heating zone respectively formed in zigzag patterns with pluralities of stripes perpendicular to the direction in which said fixing belt moves; and said first and second heating zones have heating widths corresponding to narrower and wider recording paper respectively and are bonded to each other with an electrical insulator between them.

6. A belt type fixing device according to claim 5, wherein said resistance heating band element is electrically insulated from said heating panel.

7. A belt type fixing device comprising:

a fixing belt;

a heating panel having a curved outer surface in sliding contact with the inner surface of said fixing belt and a curved inner surface on which a resistance heating band element is formed;

a pressure member, which gives tension to said fixing belt in cooperation with said heating panel, having an elastic body in sliding contact with said inner surface of said fixing belt; and a pressure roller rotated in a predetermined direction for applying pressure to toner carrying recording paper led between said pressure roller and said pressure member, said pressure member extending and applying pressure to an entire length of said fixing belt which is in contact with said pressure roller in a paper transport direction, wherein said resistance heating band element comprises;

a first heating zone having a heating width corresponding to narrower recording paper;

a second heating zone having a heating width corresponding to wider recording paper;

a first pair of terminals for supplying electric power to said first heating zone; and a second pair of terminals for supplying electric power to said first heating zone and said second heating zone at the same time.

8. A belt type fixing device according to claim 7, wherein said resistance heating band element is electrically insulated from said heating panel.

9. A belt type fixing device according to claim 7, wherein one of said first pair of terminals is common to one of said second pair of terminals.

10. A belt type fixing device according to claim 7, wherein said first and said second heating zones are bonded to each other with an electrical insulator between them.

11. A belt type fixing device according to claim 5, wherein said first and said second heating zones overlap one another in a direction perpendicular to said heating panel.

12. A belt type fixing device according to claim 7, wherein said first and said second heating zones overlap one another in a direction perpendicular to said heating panel.

13. A belt type fixing device according to claim 12, further including an insulator positioned between said first heating zone and said second heating zone.

* * * * *